US008590095B2

(12) United States Patent
Crossman

(10) Patent No.: US 8,590,095 B2
(45) Date of Patent: Nov. 26, 2013

(54) TOOTHBRUSH WITH MOVABLE HEAD PORTION

(75) Inventor: Scott P. Crossman, Rockford, MI (US)

(73) Assignee: Ranir, LLC, Grand Rapids, MI (US)

( * ) Notice: Subject to any disclaimer, the term of this patent is extended or adjusted under 35 U.S.C. 154(b) by 0 days.

(21) Appl. No.: 13/024,593

(22) Filed: Feb. 10, 2011

(65) Prior Publication Data

US 2012/0204370 A1 Aug. 16, 2012

(51) Int. Cl.
*A46B 7/02* (2006.01)

(52) U.S. Cl.
USPC ..... 15/167.1; 15/172; 15/176.1; 15/201

(58) Field of Classification Search
USPC ..... 15/167.1, 172, 201, 176.1, 176.4, 15/176.5, 176.6, 202
See application file for complete search history.

(56) References Cited

U.S. PATENT DOCUMENTS

| | | | | |
|---|---|---|---|---|
| 5,398,366 | A * | 3/1995 | Bradley | 15/167.1 |
| 5,528,786 | A * | 6/1996 | Porat et al. | 15/22.1 |
| 6,487,748 | B1 * | 12/2002 | Dardar et al. | 15/167.1 |
| 7,841,041 | B2 | 11/2010 | Moskovich et al. | |
| 7,845,042 | B2 | 12/2010 | Moskovich et al. | |
| D637,003 | S | 5/2011 | Moskovich | |
| D637,400 | S | 5/2011 | Moskovich | |
| 7,962,991 | B2 | 6/2011 | Hohlbein | |
| 7,975,343 | B2 | 7/2011 | Hohlbein et al. | |
| 7,975,346 | B2 | 7/2011 | Moskovich et al. | |
| 2003/0074755 | A1 * | 4/2003 | Ale et al. | 15/167.1 |
| 2007/0136968 | A1 * | 6/2007 | Lee | 15/167.1 |
| 2011/0179594 | A1 * | 7/2011 | Zini | 15/167.1 |

FOREIGN PATENT DOCUMENTS

| | | |
|---|---|---|
| EP | 2000048 | 12/2008 |
| EP | 2050355 | 4/2009 |
| WO | 2004014248 | 2/2004 |
| WO | 2007016066 | 2/2007 |
| WO | 2007051099 | 5/2007 |
| WO | 2007134026 | 11/2007 |
| WO | 2007149919 | 12/2007 |
| WO | 2009045980 | 4/2009 |

* cited by examiner

*Primary Examiner* — Mark Spisich
*Assistant Examiner* — Michael Jennings
(74) *Attorney, Agent, or Firm* — Warner Norcross & Judd LLP

(57) ABSTRACT

A toothbrush includes a handle, a head and a movable portion affixed to the head. In one embodiment, the head includes an upper surface and a lower surface opposite said upper surface. A recess extends into the upper surface and includes a floor, and a pair of walls extending upwardly from the floor to the upper surface. A central support may be suspended above the floor by a pair of arms that extend from opposite ends of the central support and into notches in the opposing sidewalls of the recess. A portion of the arms may be affixed in the respective notches, and a portion of the arms may be spaced from the walls of the notches to enable the arms to twist within the notches, and this enable movement of the central support.

20 Claims, 5 Drawing Sheets

TOOTHBRUSH WITH MOVABLE HEAD PORTION

BACKGROUND OF THE INVENTION

The present invention relates to toothbrushes, and more particularly to a toothbrush head that includes a movable portion.

Toothbrushes have evolved to include a variety of features to increase the effectiveness of plaque and debris removal, ease of use and control for the user, and provide increased comfort, tooth whitening and aesthetics. Recognizing that the topography of a user's teeth can be difficult for a standard manual toothbrush to contact and clean, some toothbrushes include angled handles, whereas other include tooth cleaning elements of various lengths, shapes, widths and materials that are designed to clean teeth more effectively while being relatively easier to use.

Some toothbrushes include one or more resilient materials on the upper surface of the head, which may include tooth cleaning elements extending upwardly therefrom to enable the tooth cleaning elements to match the contours of the teeth. Others include a portion of the toothbrush head that flexes or pivots with respect to the remainder of the toothbrush; however, manufacturers are continually attempting to improve the efficacy and ease of use of toothbrushes and toothbrush heads.

SUMMARY OF THE INVENTION

The present invention provides a toothbrush with a handle, a head and a movable portion affixed to the head that increases the ability of the head to match the surface contours of a user's teeth.

In one embodiment, the head includes an upper surface and a lower surface opposite the upper surface. A recess extends into the upper surface and includes a floor, and a pair of sidewalls extending upwardly from the floor. In one embodiment, each of the sidewalls defines a notch. A central support may be suspended above the floor by a pair of arms that extend from opposite ends of the central support and into the notches in the sidewalls of the recess. A portion of the arms may be affixed in the respective notches, and a portion of the arms may be spaced from the walls of the notches to enable the arms to twist within the notches. The twisting of the arms enables rotation of the central bristle support.

In one embodiment, the arms function as torsion springs to bias the central bristle support in an orientation with the upper surface of the central bristle support generally parallel to the upper surface of the head. In another embodiment, substantially all of the length of the arms extends into the respective notches, such that the arms are hidden within the notches. The arms may each include an enlarged bulb extending from the end of the arms, which may be received by receptacles in the notches. The bulbs and receptacles may be shaped to cooperate with each other, such that the bulbs fit tightly into the receptacles. In one embodiment, the bulbs are sonically welded into the receptacles. The remainder of the arms may be spaced from the walls of the notches to enable the arms to twist within the notches.

In one embodiment, cleaning elements extend from the upper surface of the head, and from the upper surface of the central bristle support. Cleaning elements may be disposed on opposite sides of each of the notches, such that the spacing of the cleaning elements along the length of the toothbrush head is not significantly effected by the length of the arms or the notches.

The movable portion of the present toothbrush may provided increased efficacy, as the upper surface of the movable portion is capable of pivoting to match the surface contours of the user's teeth. The construction of the notches, and the arms extending into the notches, enables the toothbrush to include a movable portion without significantly reducing the usable area for cleaning elements on the upper surface of the toothbrush head. For instance, when substantially all of the arms of the movable portion extend into the notches in the base of the toothbrush head, the cleaning elements may be placed continuously along the length of the toothbrush head without a significant gap to accommodate the attachment of the movable portion. These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENT

I. Overview

Figure 1:
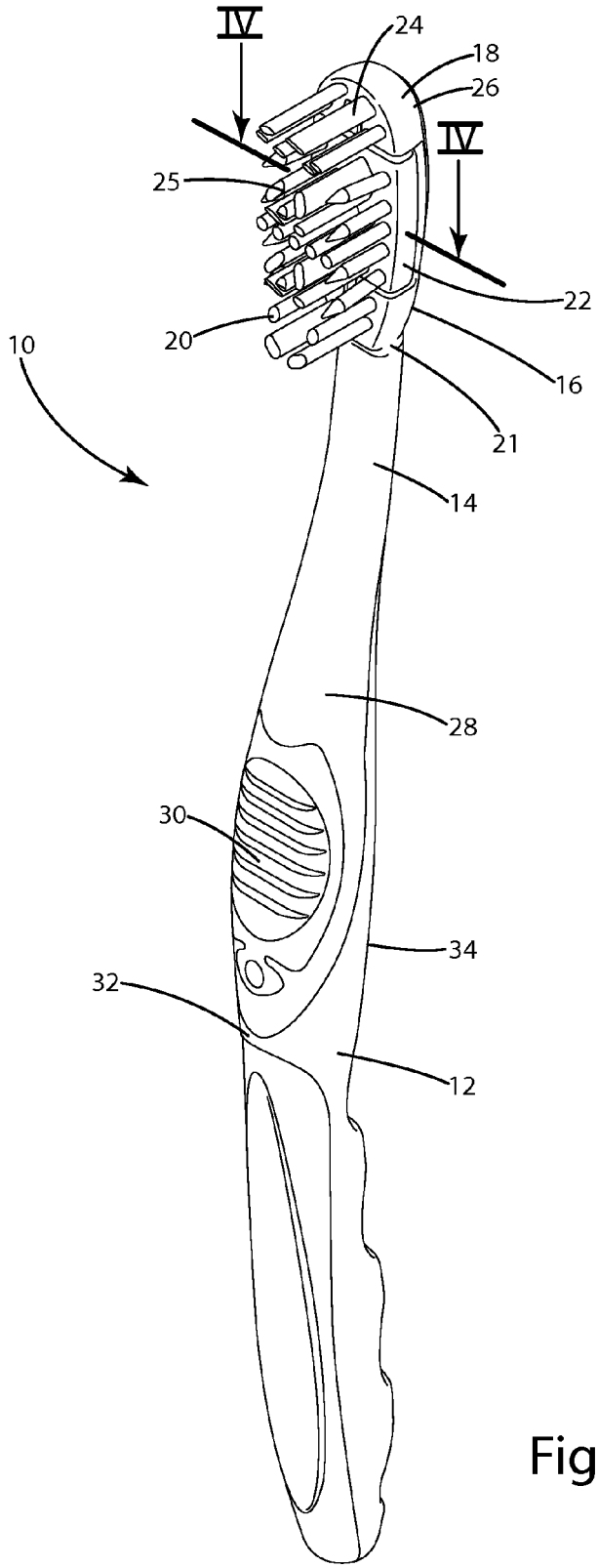
FIG. 1 is a perspective view of a toothbrush according to one embodiment of the present invention.

A toothbrush according to one embodiment of the present invention is shown in FIG. 1 and generally designated 10. In one embodiment, the toothbrush 10 includes a handle portion 12, a neck 14 extending from the handle portion 12, and a head 16 extending from the neck 14. The head 16 generally includes a base 18 supporting a first group of cleaning elements 20 at an end 21 of the head 16 proximate to the neck 14 and a second group of cleaning elements 24 at an end 26 of the head 16 that is distal from the neck 14. A central portion 22 supported by the base 18. The central portion 22 is capable of moving with respect to the base 18, and may also support a plurality of cleaning elements 25.

II. Structure

The handle portion 12 is generally an elongated structure that forms a grip to enable a user to hold the toothbrush 10. The handle 12 may include a generally rigid main body 28, which may be made from a variety of materials, and in one embodiment is formed from a molded thermoplastic, such as polypropylene. In one embodiment, the handle 12 may include a thumb grip 30 on an upper surface 32 of the handle 12, and an opposing finger grip (not shown) on the rear surface 34 of the handle. The thumb 30 and finger grips may be formed from a different material than the main body 28, such as a thermoplastic elastomer. The hardness of the elastomer may be less than that of the main body 28 to increase the ability of the user to grip the handle 12. As illustrated, the neck 14 extends from the handle 12 and tapers in diameter from the handle 12 toward the head 16.

As noted above, in the illustrated embodiment, the head 16 includes a base 18 that extends from the neck 14. The base 18 may be formed unitarily with the handle 12 and neck 14, for instance, by molding the handle 12, neck 14 and base 18 as a single, unitary piece. The base 18 generally includes a first end 21 proximate to the neck 14 and a second end 26 distal from the neck 14. The base 18 includes an upper surface 36 and a lower surface 38. In one embodiment, the base 18 includes a recess 40 defined in the upper surface 36 of the base 18 and extending substantially through the height of the base 18. The recess 40 includes a floor 42, and a pair of walls 44, 46 extending upwardly from the floor 42 to the upper surface 36 of the base 18. In the illustrated embodiment, the walls 44, 46 extend generally perpendicular to the floor 42. A first one of the walls 44 is proximate to the neck 14, forming a proximal portion 50 on the base 18 between the proximal end 22 of the head 16 and the first wall 44. The second wall 46 is distal from the neck 14. The second wall 46 faces the first wall 44, and forms a distal portion 52 of the base 18 between the second wall 46 and the distal end 26 of the head 16. The first group of cleaning elements 20 (represented by shapes on the upper surface 36 and central portion 22 in FIG. 2) extends from the upper surface 36 of the base 18 within the proximal portion 50 of the base 18, and the second group of cleaning elements 24 extends upwardly from the upper surface 36 of the base 18 within the distal portion 52 of the base 18. In one embodiment, a soft tissue scraper 55, having a plurality of protrusions 57 extending therefrom, may be disposed on the lower surface 38 of the base 18.

Figure 2:
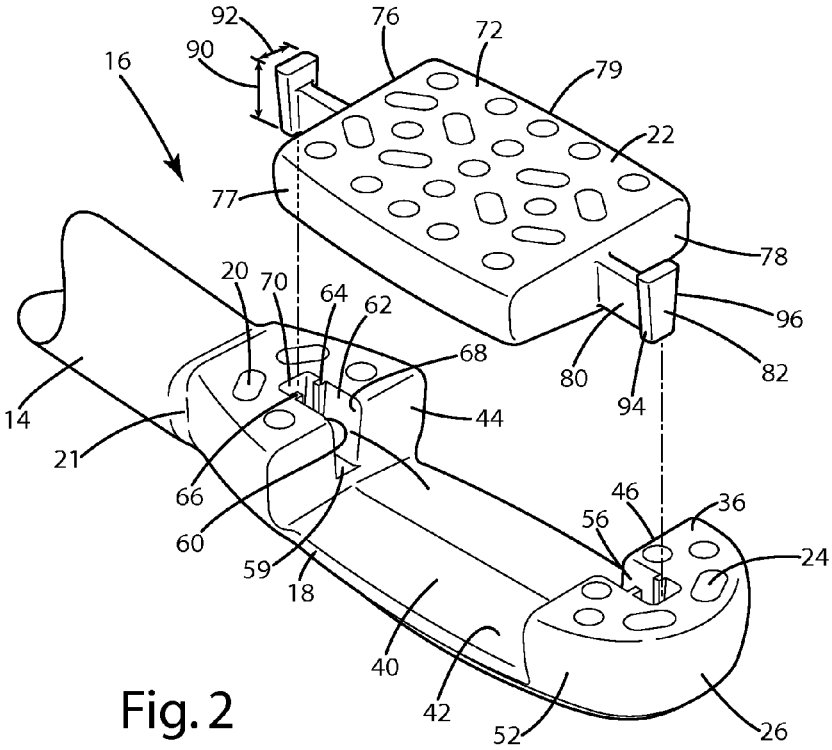
FIG. 2 is a top perspective exploded view of the toothbrush head.

As shown in FIG. 2, the wall 44 defines a notch 54 extending into the wall 44 toward the neck 14 in a direction generally perpendicular to the wall 44 and the wall 46 defines a notch 56 extending into the wall 46 away from the neck 14 in a direction generally perpendicular to the wall 46. Each notch 54, 56 includes a pair of spaced apart walls 60, 62. A pair of ribs 64, 66 are aligned with each other and extend inwardly toward each other from the opposing walls 60, 62 to divide each notch 54, 56 into a channel 68 and a receptacle 70. In the illustrated embodiment, each notch 54, 56 includes a floor 59 that is spaced a short distance above the floor 42 of the recess 40.

Figure 3:
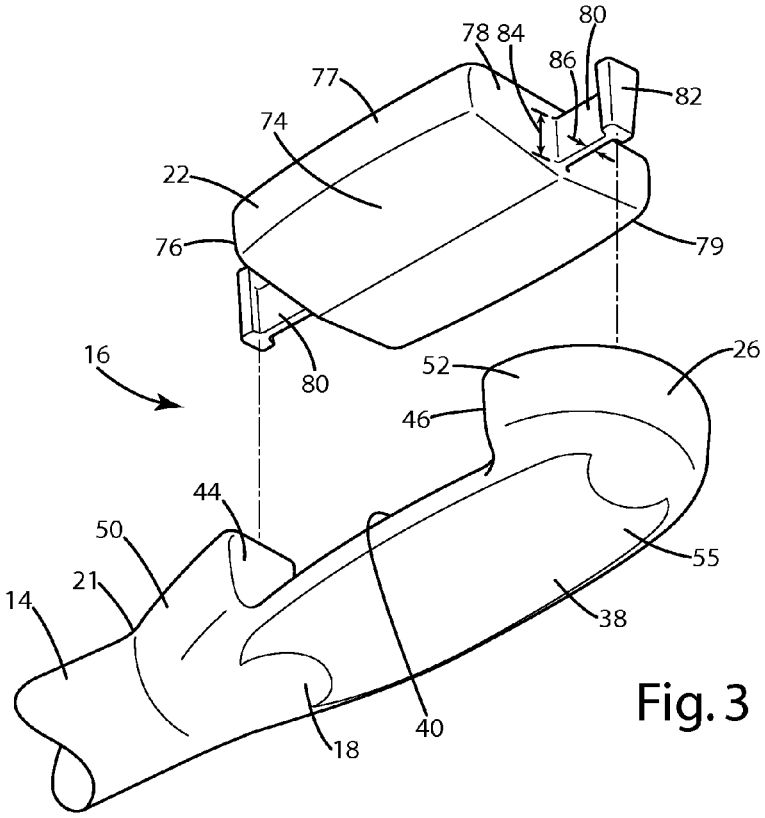
FIG. 3 is a close up bottom perspective exploded view of the toothbrush head.
Figure 4:
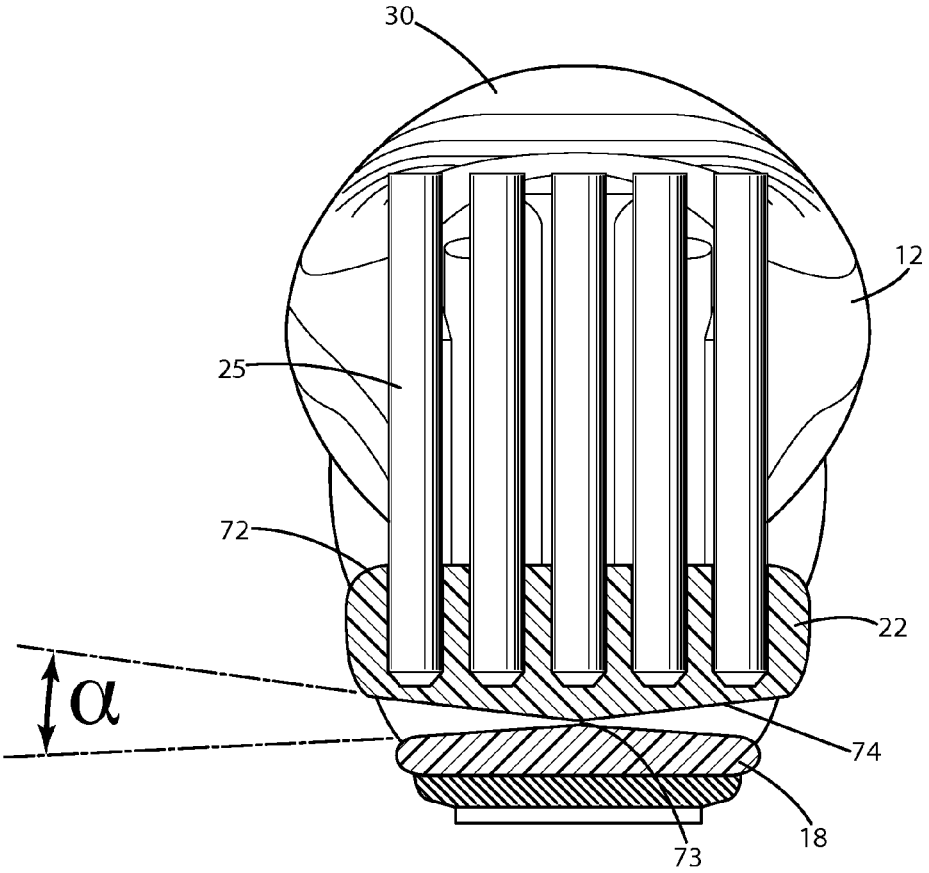
FIG. 4 is a cross sectional view of the toothbrush taken along line IV-IV in FIG. 1.
Figure 5:
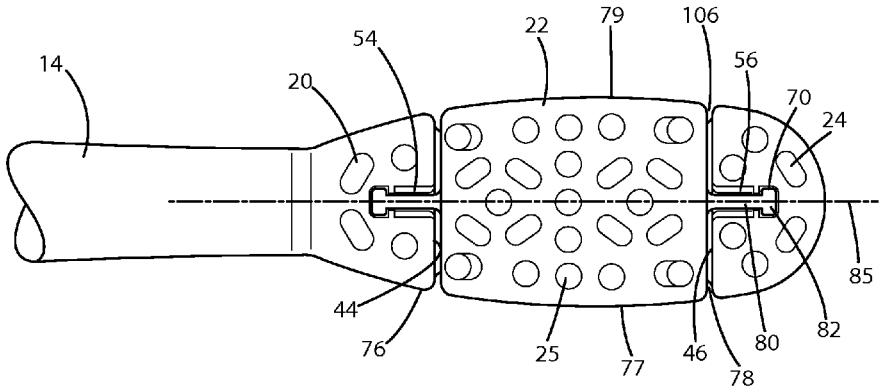
FIG. 5 is a top view of the toothbrush head.
Figure 6:
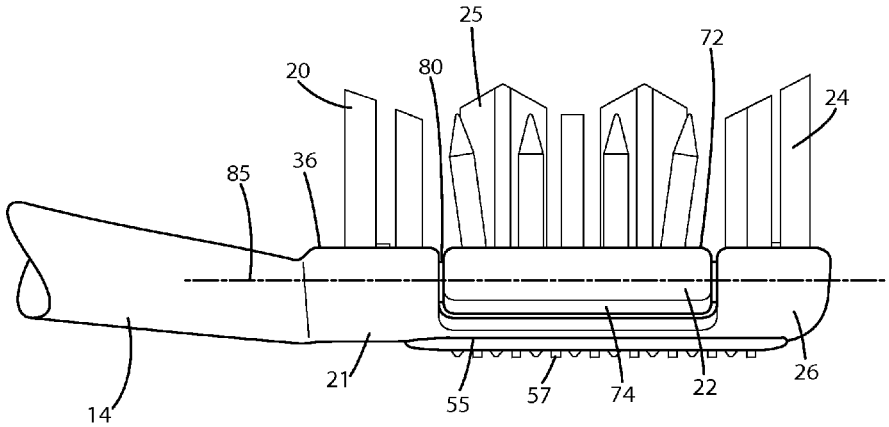
FIG. 6 is a side view of the toothbrush head.

The head 16 further includes a central portion 22 that is supported by the base 18. Referring to FIGS. 2 and 3, the central portion 22 includes an upper surface 72, a lower surface 74, a first longitudinal end 76, a second longitudinal end 78 opposite the first longitudinal end 76, and first and second lateral sides 77, 79. As shown in FIG. 4, the lower surface 74 may be v-shaped, having a midpoint 73 at the bottom of the "v." The upper surface 72 is generally flat, and supports a plurality of tooth cleaning elements 25 extending upwardly therefrom. The opposing longitudinal ends 76, 78 each include an outwardly extending arm 80 having a bulb 82 at the end. The arms 80 each include a height 84 that is substantially the same as the distance between the upper 72 and lower 74 surfaces of the central portion 22 and a width 86 defined perpendicular to the height that, in the illustrated embodiment, is smaller than the height. The arms 80 and the central portion 22 are aligned along the axis 85. This construction enables the arms 80 to function as torsion springs, wherein the arms can twist about an axis 85 that extends generally parallel to the longitudinal length of the toothbrush, and yet be biased in a direction wherein the height 84 of the arms is generally perpendicular to the upper surface 36 of the base 18. In one embodiment, the length of the arms (extending in the direction of the longitudinal length of the central portion 22) is approximately the same, or slightly greater, than the depth of the notches 54, 56. As discussed in more detail below, this enables the arms to be substantially hidden within the notches 54, 56 when the central portion 22 is secured to the base 18. The bulb 82 extends from the end of the arm 80, and, in the illustrated embodiment, includes a height 90 greater than the height 84 of the arm 80 and a width 92 greater than the width of the arm 80. In one embodiment, the bulb 82 includes opposing sides 94, 96 that converge from a top edge 98 of the bulb 82 to a bottom edge 100.

As shown in FIGS. 2-3 and 5-6, the central portion 22 is supported by the base 18 such that the central portion 22 is supported above the base 18 and is moveable with respect to the base 18. In one embodiment, the arms 80 of the central portion extend into the notches 54, 56 in the base 18. The arm 80 extending from the first longitudinal end 76 of the central portion 22 extends into the notch 54 and the arm 80 extending from the second longitudinal end 78 of the central portion 22 extends into the notch 56. The bulbs 82 on each arm 80 fit tightly into the receptacles 70 of the notches 54, 56 respectively. In one embodiment the receptacles 70 may be shaped to correspond to the converging shape of the sides 94, 96 of the bulbs 82 such that the bulbs 82 are wedged into the receptacles 70. The bulbs 82 may be permanently secured into the receptacles 70, for example, by sonically welding the bulbs 82 into the receptacles 70. Alternatively, the bulbs 82 may be secured in the receptacles by an adhesive or another permanent or releasable attachment method. The arms 80 extend through the respective notches 54, 56 such that they are spaced from the walls 60, 62, providing room for the arms 80 to twist within the notches 54, 56. The lower surface 74 of the central portion 22 is supported above the floor 42, such that there is a gap between the lower surface 74 and the floor 42. The v-shape of the lower surface 74 creates an angle $\alpha$ between each lateral side of the floor 42 and the lower surface 74. As noted above, the arms 80 are generally enclosed by the notches 54, 56 when the central portion 22 is secured to the base 18. One or more of the cleaning elements 20 on the proximal portion 50 and one or more of the cleaning elements 24 on the distal portion 52 of the base 18 may be positioned on opposing sides of the notches 54, 56, such that the cleaning elements 20, 24, and 25 are disposed generally continuously across the longitudinal length of the head 16, with no significant gaps between cleaning elements caused by the gaps 104, 106 between the longitudinal ends 76, 78 of the central portion 22 and the first 44 and second 46 walls of the base 18.

III. Manufacture and Operation

Manufacture of the present invention includes the steps of: (1) molding the handle 12, neck 14 and base 18, (2) molding the central portion 22 and (3) securing the central portion 22 to the base 18. In one embodiment, the handle, 12, neck 14 and base 18 are molded as a single, unitary piece. The gripping material may be overmolded onto the handle 12. The central portion 22 may be molded separately, from the same or similar material as the base 18. In one embodiment, the central portion 22 is attached to the base 18 by inserting the bulbs 82 on the central portion 22 into the respective receptacles 70, with the sides 94, 96 of each bulb 82 engaging the receptacles 70. The bulbs 82 are secured within the receptacles 70 by sonic welding, or by another attachment method.

Figure 7:
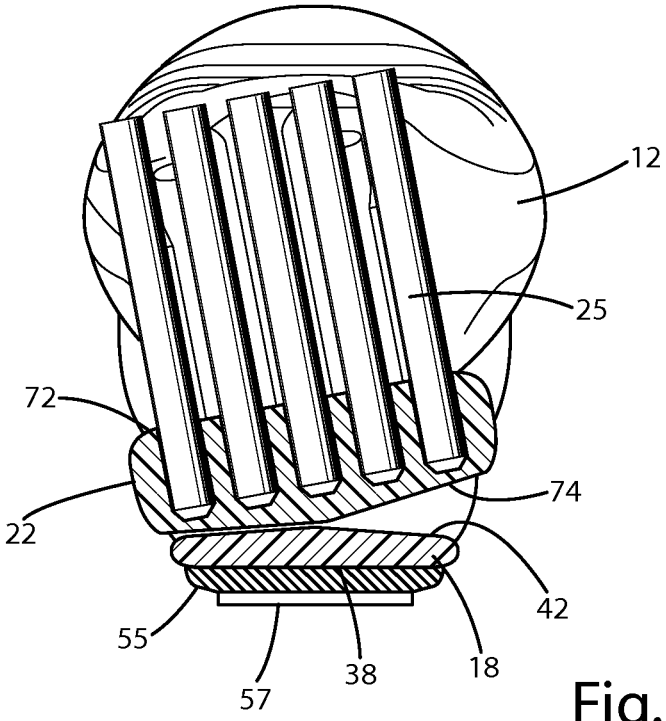
FIG. 7 is a cross sectional view of the toothbrush taken along line IV-IV in FIG. 1 with a portion of the toothbrush head pivoted in a first position.
Figure 8:
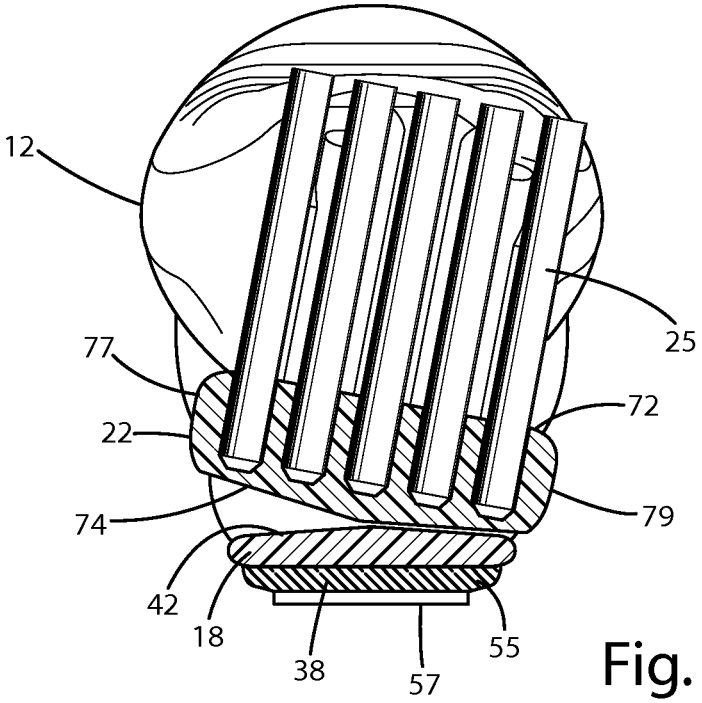
FIG. 8 is a cross sectional view of the toothbrush taken along line IV-IV in FIG. 1 with a portion of the toothbrush head pivoted in a second position.

In operation, a user may grip the handle 12 of the toothbrush 10 and insert the toothbrush 10 into the user's mouth with the cleaning elements 20, 24 and 25 pressed against the user's teeth. Referring to FIGS. 7 and 8, as the central portion 22 is pressed against the user's teeth, the force on the upper surface 72 of the central portion 22 on either side of the axis 85 causes the arms 80 to twist and the central portion 22 to rotate generally about the axis 85. The arms 80 function as torsion springs to bring the central portion 22 back to a horizontal position when force is removed from the head 16. In one embodiment, the force on the toothbrush head may cause the central portion 22 to bend, such that the lower surface 74 of the central portion 22 contacts the floor 42 of the base 18. The midpoint 73 at the bottom of the "v" on the central portion 22 may engage the floor 42, wherein the central portion 22 can pivot about the midpoint 73. The angle of the "v" on the lower surface 74 and the draft angle on the floor 42 may be predetermined to set the angle $\alpha$ through which the central portion 22 can pivot.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

I claim:

1. A toothbrush comprising:

a body including a handle portion and a head portion, said head portion including an upper surface and a lower surface opposite said upper surface, said head portion defining a recess extending into said upper surface, said recess having a floor and a pair of walls extending upwardly from said floor to said upper surface, said walls facing each other, and each of said walls defining a notch extending into said wall;

a central support suspended above said floor, said central support including an upper surface, a lower surface facing said floor, a first end facing one of said walls and a second end facing the other of said walls, each of said first end and said second end including an arm extending outwardly therefrom, said arms extending in opposite directions from each other and defining an axis extending through said arms and said central support such that both of said arms and said central support are aligned along said axis, each said arm extending into one of said notches, a portion of each said arm being affixed within said respective one of said notches, wherein said central support is capable of rotating about said axis with respect to said head portion with said arms twisting about said axis and functioning as torsion springs; and cleaning elements extending from said upper surface of said head portion and said upper surface of said central portion.

2. The toothbrush of claim 1 wherein said arms include a length, and substantially the entire said length of said arms extends into said respective notches such that said arms are hidden within said notches.

3. The toothbrush of claim 2 wherein at least some of said cleaning elements on said upper surface of said head portion are positioned on opposing sides of said notches.

4. The toothbrush of claim 3 wherein said arms bias said central support in a position with said upper surface of said central support being generally parallel to said floor of said recess.

5. The toothbrush of claim 4 wherein said lower surface of said central support is v-shaped, defining an angle between said lower surface of said central support and said floor.

6. The toothbrush of claim 1 wherein said arms are aligned along an axis, said central support capable of rotating about said axis.

7. The toothbrush of claim 1 wherein said arms each include a base, a distal end, and a bulb at said distal end, said bulbs affixed within said notches.

8. The toothbrush of claim 7 wherein said notches each include a pair of opposed, inwardly extending ribs dividing each said notch into a channel and a receptacle.

9. The toothbrush of claim 8 wherein said bulbs are affixed within said receptacles, leaving the remainder of said arms free to twist within said channels.

10. The toothbrush of claim 9 wherein said arms each include a height extending generally perpendicular to said upper surface of said central support, and a width extending generally parallel to said upper surface of said central support, said height being greater than said width.

11. A toothbrush comprising:

a handle;

a head extending from said handle, said head including a base, first and second bristle supports extending upwardly from said base, and a central bristle support connected to said first and second bristle supports and suspended above said base, said first and second bristle supports each defining a notch, said notches facing each other, said central bristle support including a pair of arms extending in opposite directions from opposed ends of said central bristle support such that said arms and said central bristle support are all aligned along an axis, each of said arms extending into one of said notches, a portion of each of said arms being affixed within said one of said notches, wherein said central bristle support is capable of moving with respect to said base by twisting said arms, such that said central bristle support and a portion of said arms rotate together about said axis extending through said central bristle support and said arms when a force is applied to said central bristle support; and cleaning elements extending from said first bristle support, said second bristle support and said central bristle support.

12. The toothbrush of claim 11 wherein said arms each include a distal end, and a bulb extending from said distal end, wherein only said bulbs are attached within said notches.

13. The toothbrush of claim 12 wherein said notches each include a channel portion and a receptacle portion, said bulbs on said arms being permanently affixed within said receptacles, said channel portion having a pair of opposed sidewalls, at least a portion of said arms being spaced from said sidewalls.

14. The toothbrush of claim 13 wherein toothbrush head defines a longitudinal axis extending along a length of said head from said handle to a distal tip of said head, said arms aligned along said longitudinal axis such that said central bristle support and said arms are capable of twisting about said longitudinal axis.

15. The toothbrush of claim 11 wherein said arms each define a length extending from a base at said central bristle support to an end opposite said base, wherein substantially all of said length of said arms is disposed within said respective notches such that said arms are hidden within said notches.

16. The toothbrush of claim 15 including at least a pair of said cleaning elements on opposing sides of each of said notches, such that said arms each extend between one of said pairs of cleaning elements.

17. A toothbrush comprising:

a handle including a longitudinal length;

a head extending from said handle, said head including a base, a proximal bristle support extending upwardly from said base and positioned adjacent said handle, a distal bristle support extending upwardly from said base and positioned at a distal end of said head, and a central bristle support connected between said proximal and distal bristle supports, said central bristle support having a lower surface spaced above said base and a pair of opposed ends, said proximal and said distal bristle supports each including an upper surface and a sidewall that cooperate to define a notch, said central bristle support including a pair of arms extending in opposite directions from said opposed ends of said central bristle support, said arms extending generally parallel to said longitudinal length of said handle and defining an axis wherein both of said arms and said central support are aligned along said axis, each of said arms extending into one of said notches, a portion of each of said arms being affixed within said one of said notches, wherein said central bristle support is capable of rotating about said axis with respect to said base by twisting said arms about said axis when a force is applied to said central bristle support; and cleaning elements extending from said first bristle support, said second bristle support and said central bristle support.

18. The toothbrush of claim 17 wherein said arms each include an end, and a bulb extending from said end, said bulb of each said arm being permanently secured within said respective notch.

19. The toothbrush of claim 18 wherein said notches each include a channel portion and a receptacle portion, said channel portion extending from said sidewall to a pair of ribs projecting into said notch, said receptacle portion extending from said pair of ribs to a rear wall of said notch, wherein said bulb of each of said arms is permanently affixed in said receptacle portion of each said notch and wherein each said arm is not affixed within said channel portion of said notch such that arms are capable of twisting within said channel portions of said notches.

20. The toothbrush of claim 19 wherein said arms each define a length extending between said central bristle support and said end of said arms, substantially all of said length of each of said arms extending into said respective one of said notches.

* * * * *